US005795460A

United States Patent [19]

Al-Jiboory et al.

[11] Patent Number: 5,795,460

[45] Date of Patent: Aug. 18, 1998

[54] METHOD FOR REMOVAL OF FILMS FROM METAL SURFACES USING ELECTROLYSIS AND CAVITATION ACTION

[75] Inventors: Muhammed Al-Jiboory; Norman Chow; Cliff Low Dor Mui, all of Vancouver; Klaus H. Oehr, Surrey; Remy Stachowiak, Vancouver, all of Canada

[73] Assignee: Dynamotive Corporation, Vancouver, Canada

[21] Appl. No.: 630,608

[22] Filed: Apr. 10, 1996

[51] Int. Cl.[6] ..... C25F 1/04; C25F 3/02; C25D 5/20; B08D 3/12

[52] U.S. Cl. ..... 205/705; 205/709; 205/710; 205/711

[58] Field of Search ..... 205/705, 709, 205/710, 711

[56] References Cited

U.S. PATENT DOCUMENTS

| | | | |
|---|---|---|---|
| 3,525,243 | 8/1970 | Chrablow | 72/39 |
| 4,795,537 | 1/1989 | Timewell | 204/129 |
| 5,407,544 | 4/1995 | Oehr et al. | 204/141.5 |
| 5,409,594 | 4/1995 | Al-Jiboory et al. | 205/148 |
| 5,449,447 | 9/1995 | Branders | 205/141 |
| 5,464,510 | 11/1995 | Oehr et al. | 204/141.5 |

OTHER PUBLICATIONS

Fuchs, F., Multi-Tank Ultrasonic Cleaning Systems, Metal Finishing, May 1992.

Lawson, C., Aqueous Systems for Cleaning Strip, Metal Finishing, May 1987.

Line, J./Higgins, R., Ultrasonic Cleaning, Wire Journal International, Jun. 1995.

*Primary Examiner*—Arun S. Phasge

*Attorney, Agent, or Firm*—Jensen & Puntigam, P.S.

[57] ABSTRACT

To remove films, such as oxides and lubricants, from a metal substrate, mechanical or thermal stress is first applied to the films so as to rupture the film to the substrate. The substrate is then moved through an electrolysis cell having one or more electrode elements of one electrical polarity spaced from the moving substrate defining another electrode element with the opposite polarity. An electrical signal is applied to the electrodes, and the electrical signal flows down to the metal substrate, resulting in an etching or pitting of the surface of the metal substrate. Following the electrolysis cell, the moving substrate is immersed in a cavitation fluid. Energy, either sonic or ultrasonic, is generated and focused onto the moving substrate so that cavitation bubbles are formed in the pitted portions of the metal substrate beneath the film. When the cavitation bubbles expand and collapse, the resulting cavitational shock wave and the microjet action produce a lifting effect on the film relative to the metal substrate.

29 Claims, 4 Drawing Sheets

FIG. 1
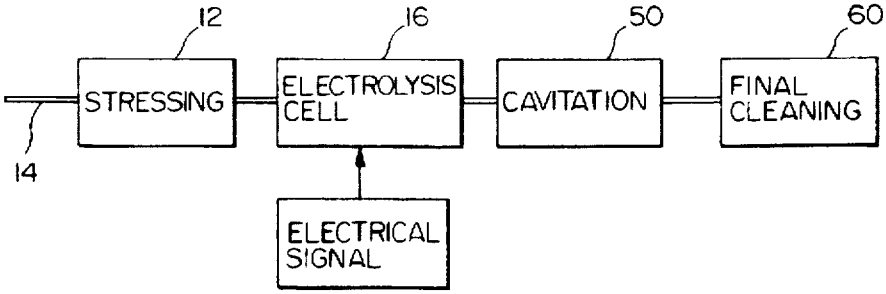
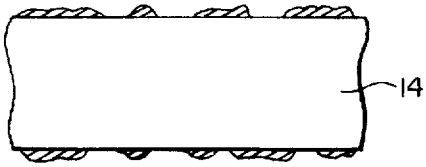
FIG. 2A
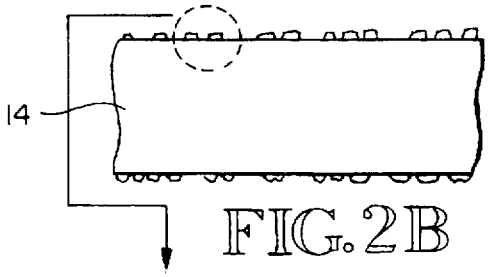
FIG. 2B
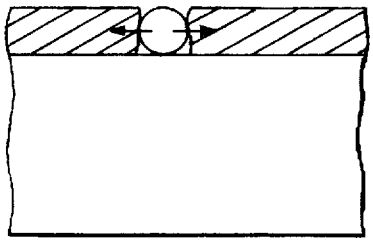
FIG. 2E
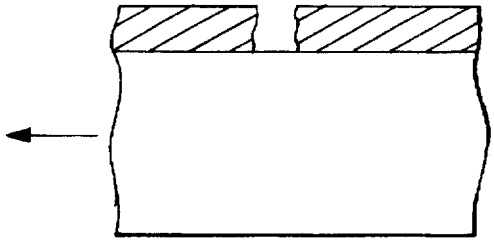
FIG. 2C
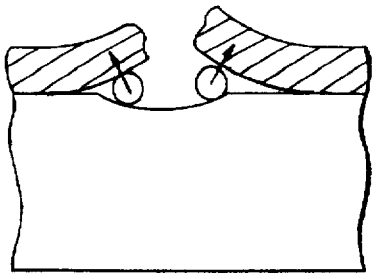
FIG. 2F
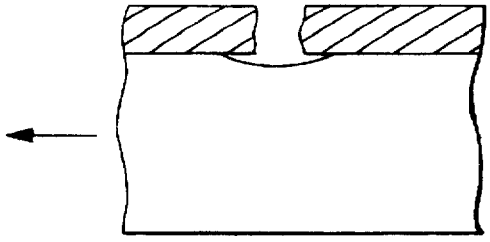
FIG. 2D FIG. 3A
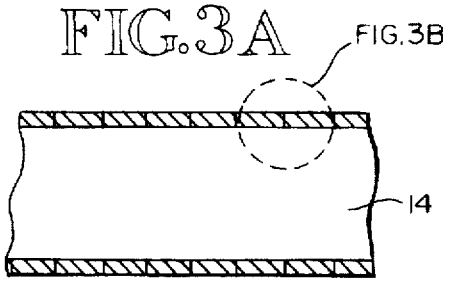
FIG. 3B
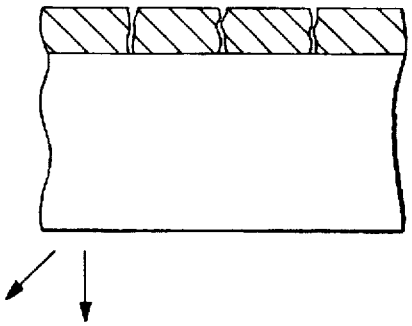
FIG. 3C
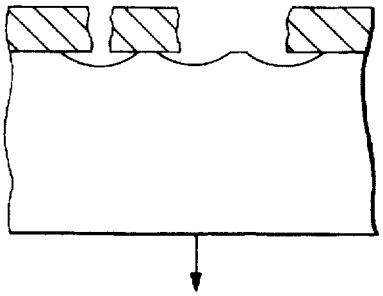
FIG. 3D
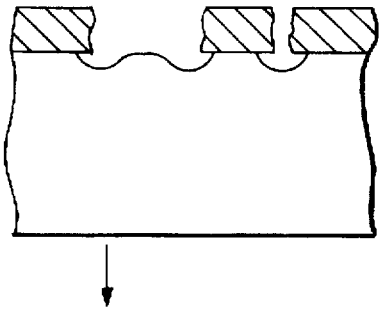
FIG. 3E
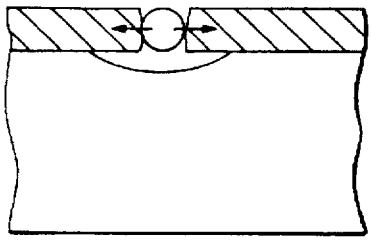
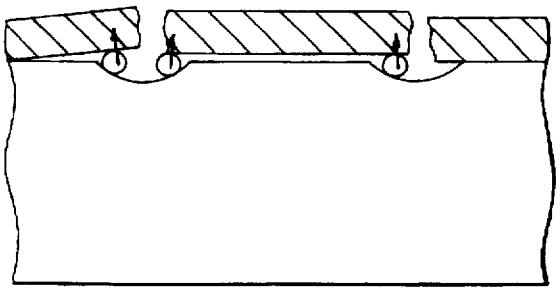
FIG. 3F

METHOD FOR REMOVAL OF FILMS FROM METAL SURFACES USING ELECTROLYSIS AND CAVITATION ACTION

TECHNICAL FIELD

The present invention relates generally to a method and system for removing films, such as lubricants and oxides, from a moving metal substrate, including for example wires, rods, bars, strips and sheets.

BACKGROUND OF THE INVENTION

In the manufacture of various metal goods, such as steel wire, bars and strips, lubricants and/or oxide films typically remain on the metal following initial processing. For instance, lubricant films remain on the surface of certain manufactured metal goods as a result of processing steps which require friction reduction, which occurs for instance in the manufacture of metal wires, where the wires are "drawn" from metal rods.

Oxide films are formed on other manufactured metal goods (substrate) surfaces, such as steel, when the metal is heated to high temperatures, in the presence of oxygen, for the purpose of reducing tensile strength. Various other kinds of films can be present as well on a metal substrate at the conclusion of current manufacturing processes.

Such films (lubricants and oxides) typically must be removed from the metal substrate before subsequent processing steps, such as galvanizing, casting or electroplating can occur. These additional processing steps typically will not be successful unless the lubricant and/or oxide films have been thoroughly removed. The efficient and inexpensive removal of such films is thus quite desirable.

Lubricant-type films are often removed through techniques involving solvent and vapor degreasing, as well as alkaline or acid cleaning. The solvents or chemicals used in these methods, however, are frequently corrosive, expensive to neutralize after use or are health hazards, requiring special handling methods. In addition, mechanical agitation or electrolytic action has been used in combination with chemical cleaning and still further, ultrasonic transducers have been used to produce an agitation of the chemicals around the metal substrate.

In the electrolytic system, an electrolysis cell is used which involves an anodic "counter" electrode, a metal goods substrate and an acidic, neutral or alkaline electrolyte. Such systems, however, frequently require substantial investment and often still do not result in a complete cleaning of the metal substrate, likely due to poor electrolyte rinsing achieved in the absence of cavitation or poor rupturing of the oxide film.

For instance, U.S. Pat. No. 5,449,447 describes a process of electrolytic "pickling" and degreasing with an electrolytic system using chloride-containing electrolytes, from chloride salts or hydrochloric acid. The present inventors' attempt to use this process to pickle 1006 low carbon steel wire (2.5 mm in diameter) moving at a speed of 100 ft/min, with a 0.48 amperes $cm^2$ current density, at a frequency of 54 Hz with a 49.1% duty cycle, in an electrolysis bath of 120 grams/liter sodium chloride electrolyte concentration at a temperature of 38° C. for 1.6 seconds was not successful. Toxic chlorine gas was produced and the surface of the wire had residual oxide.

With respect to removal of oxide-type films in particular, typical cleaning methods include the use of chemicals or some form of mechanical cleaning or some combination of the two. Mechanical systems such as abrasive blasting and bending of the substrate (such as for wire or wire rods) are capable of removing a substantial amount of oxide scale but still do not achieve a satisfactorily complete cleaning. In chemical cleaning, such as for instance acid pickling, the metal substrate is immersed in an acid bath. This technique is widely used, but it does have disadvantages. First, the acid itself is expensive, corrosive and toxic. An acid residue is also often frequently left on the metal substrate, even after rinsing, thus rendering the metal piece susceptible to accelerated corrosion in the absence of further treatment. Further, the acidic concentration of the pickling baths are difficult to maintain and uniform etching of the metal surface is difficult.

In still other oxide cleaning attempts, electrolytic techniques and/or ultrasonic energy have been used. Ultrasonic cleaning, including ultrasonic waves, is shown in U.S. Pat. No. 5,409,594, both in the sonic frequency range and in the ultrasonic range (typically 20–40 kHz, although the '594 patent suggests frequencies above 500 kHz). The ultrasonic arrangements in particular have been found to enhance the oxide cleaning of mechanical and/or acid techniques, but do not by themselves produce a satisfactory level of cleanliness for most applications.

Lastly, there have been attempts, such as shown in U.S. Pat. No. 5,407,544, to combine a mechanical stressing of the substrate with electrolytic cleaning to remove oxides from a continuously moving metal substrate. The electrolyte in that particular arrangement is sodium chloride and water, which does not have the hazards of an acid-based system. However, these combined systems do have several disadvantages, including a relatively long electrolysis time and an increase in tensile strength in the metal substrate due to the mechanical stressing of the substrate caused by monopolar spring-loaded electrical contact rollers or guides.

In addition, electrical sparking can occur due to the application of high currents through electrical contact points which may in turn result in an undesirable degradation of the substrate, such as martensite formation on steels with high carbon content.

DISCLOSURE OF THE INVENTION

Accordingly, the present invention is a system for removing films from metal surfaces, comprising the steps of: means for applying stress to a film on a surface of a metal substrate, so as to rupture the film; means for moving the substrate through an electrolysis cell having two electrode means, wherein the substrate comprises one of said two electrode means; means for applying an electrical signal to the said electrode means such that the electrical signal flows to the substrate, resulting in a conditioning effect on at least one of (1) the film and (2) a surface of the metal substrate; immersing said metal substrate in a cavitation fluid and moving said substrate therethrough; and generating energy in the cavitation fluid, toward the metal substrate, so that cavitation bubbles are created in locations relative to the film such that when said bubbles expand and collapse, effects are produced which tend to remove the film from the metal substrate.

BRIEF DESCRIPTION OF THE DRAWINGS

FIG. 1 is a block diagram of the present invention.

FIGS. 2A–2F show a series of steps in the process of the present invention for a lubricant film.

FIGS. 3A–3F show a series of steps in the process of the present invention for an oxide film.

BEST MODE FOR CARRVING OUT THE INVENTION

Figure 4A:
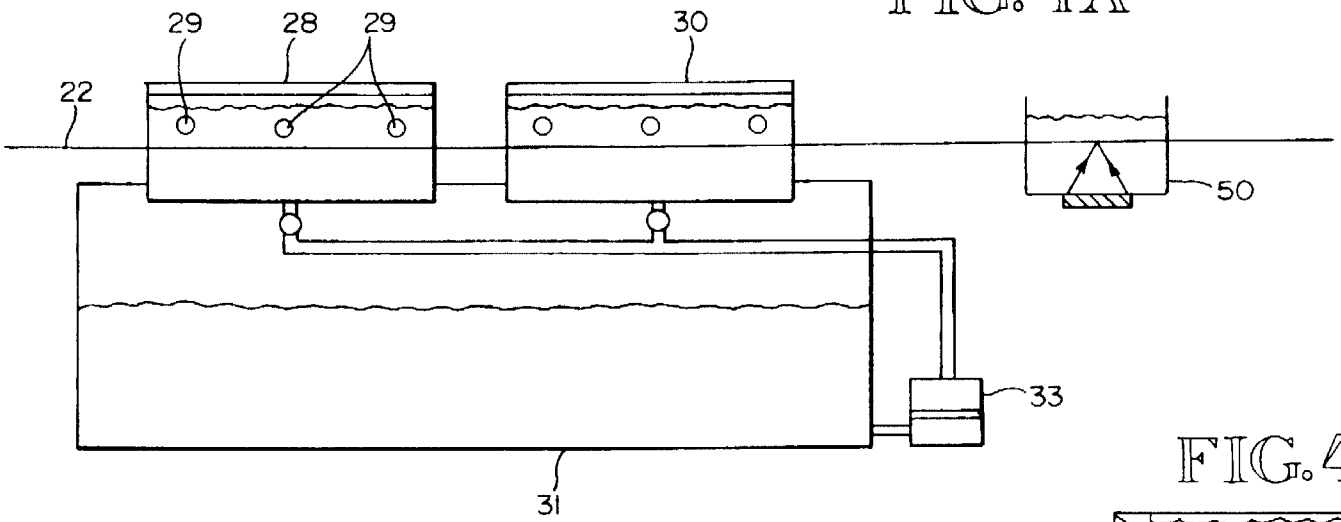
FIGS. 4A–4E is a block diagram showing variations of one embodiment of the present invention.
Figure 4D:
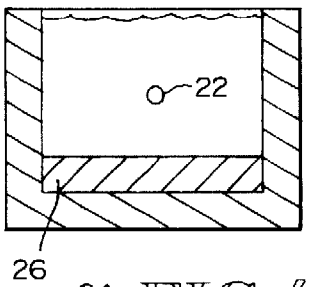
Figure 4E:
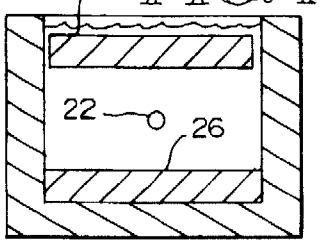

As indicated above, the present invention is a system and method for removing films, including various lubricants and oxides, from an underlying metal substrate. The metal substrate may take various shapes and sizes. Examples of such substrates (metal goods) include conventional rods and wires, but also include bars of various dimensions and configurations as well as metal strips and even large sheets. In the manufacture of such metal goods, the resulting product often is covered with a film such as a lubricant or oxide, as discussed above. The present invention is capable of removing a wide variety of oxide films, with various mechanical and metallurgical properties, as well as lubricants, from such metal goods. A thorough cleaning, as indicated above, is quite important in achieving good results from subsequent processing steps, including galvanizing and/or electroplating, among others.

In the present invention, referring for instance to FIGS. 1, 4 and 5, relative to the removal of oxide films in particular, a mechanical or thermal stressing of the film-covered substrate is first completed. This mechanical or thermal stress step results in at least a partial cracking or rupturing of the film, providing access to the metal substrate 14 therebeneath. This is shown diagrammatically at station 12 in FIG. 1 and pictorially in FIG. 3B.

FIG. 3A shows a microscopic view of a substrate with an oxide film. Mechanical rupturing can be accomplished by a wide variety of techniques, including the application of tensile stress or bending of the substrate, either in one or two directions, including slightly offset bends, or by twisting or "shot blasting". Ultrasonic vibration or high energy water jets able to generate cavitation effects at the metal substrate surface also may be used to produce a cracking or rupturing of the oxide films. These are examples of such stressing techniques, but are not intended to be exclusive.

In the use of thermal stress, significant change in temperature gradient is used to produce cracking or rupturing of the oxide or to enhance the effect of mechanical rupturing. Hence, thermal stress can be used either alone or in combination with mechanical stress, depending upon the character of the oxide film and the requirements to rupture the oxide.

This step of mechanical and/or thermal stressing is addressed in more detail in U.S. Pat. No. 5,407,544 and U.S. Pat. No. 5,464,510, both of which are assigned to the assignee of this invention.

After the step of mechanical or thermal stress, which results in a cracking or rupturing of the oxide film, as shown in FIG. 3B, the metal substrate 14 is moved through an electrolysis cell, which is shown generally at station 16 in FIG. 1. The electrolysis cell 16 may take various configurations and arrangements; it typically has an electrolyte which is a solution of a neutral salt, such as for example sodium sulphate or potassium sulfate and water, which inherently overcomes many of the disadvantages of conventional acid and alkaline electrolytic cleaning systems.

The electrolyte can be altered somewhat to accommodate the particular characteristics of the metal substrate. For instance, the electrolyte can be made slightly acidic, neutral or slightly alkaline. The salts which can be added to produce those results, respectively, include sodium hydrogen sulfate, sodium sulfate and sodium carbonate. Also, a mixture of different electrolytes can be used; for instance, a neutral salt, such as sodium sulfate, can be mixed with dilute sulfuric acid, or sodium carbonate can be mixed with a dilute sodium hydroxide. Further, the electrolyte can be selected so that oxygen is generated at the surface of the metal substrate, in addition to the metal ions which are produced and go into solution during the electrolytic process.

The electrolysis cells can have various forms. FIGS. 4A–E and 5A–D show two different electrolysis cell arrangements. In FIGS. 4A–E, there are two successive cell baths. In the first cell bath 20, the metal substrate 22 forms the cathode of the cell, while one or two spaced, essentially insoluble graphite, or iridium oxide on titanium, electrodes 24, 26 (FIGS. 4B, 4D, 4E) form the anode and are connected to the positive side of a source of electrical current. In the second electrolysis cell 30, the arrangement is reversed so that the metal substrate 22 forms the anode, and two spaced, essentially insoluble electrodes 32 and 34, for instance stainless steel, form the cathode.

Each cell has overflow holes 29—29, through which electrolyte flows into an overflow tank 31, where it is pumped up to the cells by pump 33 through conventional valves. FIGS. 5A–5D show an arrangement where there are three successive electrolysis cells for treatment of a substrate 35, in which the first cell 36 is anodic (the metal substrate is the anode), the second cell 38 is cathodic and the third cell 40 is anodic. Each cell has two spaced electrodes of a polarity opposite to that of the substrate, for instance anodic electrodes 37 and 39 for the first cell 36. Other systems can be used which include additional successive cells.

It should be understood, with respect to both of the embodiments of FIGS. 4 and 5, that the electrodes need not be mounted vertically as shown. For instance, one or two horizontal electrodes can be used, either perforated or unperforated. This is illustrated in FIGS. 4D and 4E. The electrodes further can have different shapes, such as L-shaped, U-shaped or curved hemispherical shaped.

Alternatively, a single electrolysis cell can be used, in which the polarity of the substrate and the spaced electrodes is periodically reversed, so that during a first time period, the metal substrate forms the cathode and the spaced electrodes form the anode, while in the next time period, the metal substrate forms the anode and the spaced electrodes form the cathode. In none of the above arrangements, however, is there direct contact between the moving metal substrate and the electrical system. This prevents the undesirable effect of sparking.

The electrical driving signal for the electrolysis cell can be applied in various ways. The electrical signal can be an alternating current, a pulsating direct current or a constant direct current. The pulsating DC signal further can have various duty cycles. However, the electrical signal should not be monopolar. Pulsating direct current electrolysis treatment of metal substrates is described in more detail in U.S. Pat. No. 5,407,544 and in U.S. Pat. No. 5,409,594, both owned by the assignee of the present invention.

FIGS. 2A (for lubricants) and 3A (for oxides) show the condition of the films microscopically prior to electrolysis. The electrolysis bath itself has an important conditioning/etching effect on the substrate and/or the film, resulting in the creation of appropriate sites, as discussed below, to accommodate cavitation bubbles produced in the next step of the process of the present invention. In addition, when the surface of the substrate is etched, fine particles of metal are removed, which in turn provide nuclei for such cavitation bubbles. FIG. 2B is a microscopic view of a lubricant film following electrolysis.

Microscopic cavities or pits are typically formed in the surface of the substrate beneath the lubricant/oxide films. The cavities or pits in a particular area of the substrate continue to grow as long as that area of the substrate is present in the electrolysis cell. The actual shape of the pit can be controlled through the operating parameters of the electrolysis cell and the electrical signal applied to the electrolysis cell, including, with respect to the electrical signal, its current density and duty cycle, and with respect to the electrolysis cell, the chemistry of the electrolyte, as well as the concentration, temperature and pH thereof.

Scanning electron microscopy appears to indicate that deeper cavities, craters or pits are formed when the electrolyte has a low electrolyte concentration, electrolysis time is increased, and when the electrical signal has a high duty cycle and/or low current density. The deeper pits are shown representationally in FIG. 3D. Shallower cavities or pits are formed with a high concentration electrolyte, reduced electrolysis time and/or a low temperature electrolyte, and a high density and/or low duty cycle electrical signal, such as shown in FIG. 3C. FIG. 2C for lubricants shows basically no cavities in the substrate while FIG. 2D shows shallow cavities or pits. FIGS. 2C/2D and FIGS. 3C/3D show alterative microscopic views of lubricants and oxides, respectively, following the electrolysis step.

The electrolysis step, because of the formation of hydrogen gas at the surface of the substrate, when the substrate is the cathode, will assist in rupture of the oxide or lubricant, in addition to its basic conditioning/etching effects on the substrate.

In the next step of the present invention, after the film and/or the surface of the metal substrate has been ruptured and conditioned by electrolysis, cavitation bubbles are formed in the cavities beneath the film or in cracks in the film. This is shown at block 50 in FIG. 1. By cavitation in the present invention is meant the formation, growth and collapse of minute bubbles (1–10,000 microns in diameter). The formation of cavitation bubbles occurs when a liquid is exposed to an alternating pressure wave, such as ultrasonic waves, having a peak pressure amplitude which exceeds the hydrostatic pressure in the liquid. The cavitation bubbles are filled with either gas or vapor from the liquid.

The cavitation bubbles typically form around a nucleus of microscopic particles of the substrate or dust or impurities in the liquid or they may be formed around gas bubbles, which are in the vicinity of the ruptures, holes or cavities of the film and/or the substrate. Cavitation occurs when the radius $r_0$ of the bubbles achieves a resonance value according to the following formula:

$$r_0=(3.9/f)^{2/3}$$

where f is the frequency in Hertz of the pressure wave creating the bubbles and $r_0$ is in centimeters.

At resonance size, the cavitation bubbles resonate violently, producing localized "microjets" of liquid around them. They then collapse, releasing their gas or vapor content to the liquid and producing a shock wave that often exceeds 1000 atmospheres. It is the effect of the resulting shock wave due to the collapse of the cavitation bubbles combined with the effect of the microjets which produces a significant cleansing action on the surface film, whether it be an oxide or lubricant or both.

The effective range of the cavitation shock wave and the microjet action is approximately 1.5 times he resonance radius of the cavitation bubbles. Because this is such a small distance, cavitation bubbles typically are only truly effective for cleaning if they are in contact with the surface which is to be cleaned of the film. The amplitude of the shock waves is dependent upon the acoustic power of the source of acoustic energy and inversely dependent upon the operating frequency.

The impact of the shock waves created by cavitation on a film produces a high shear stress in the film, which results in a cracking or rupturing of the film. The microjet action both erodes any particles on the surface and provides a stream of fluid tangential to the surface of the substrate, resulting in a flushing effect on the ruptured film relative to the substrate. Typically, cavitation is very effective with respect to a harder film, such as an oxide. With a more elastic film, such as a lubricant, the film is not cracked or broken into smaller pieces, but instead is peeled off in large pieces by the growing cavitation bubbles. Also, the addition of certain chemicals including acids, alkalines and solvents, to the cavitation fluid can assist the removal of lubricants by dissolving that film during cavitation.

For a given cavitation frequency, only bubbles within a certain range size will undergo the desired cavitating effect. Bubbles smaller than the resonance size will grow by a diffusion process until they reach the desired resonance size. Bubbles which are larger than the resonance size will not cavitate. They will oscillate and grow until they become more buoyant and then move to the surface of the liquid. Cavitation bubbles are shown in the substrate cavities in FIGS. 2F and 3F, while FIGS. 2E and 3E shown the cavitation bubbles in cracks in the film.

When cavitation bubbles are produced in pits or cavities, either in film cracks or beneath the film on the substrate, the resulting shock waves and microjets produced by the cavitation result in a lifting force which in effect peels or lifts off the surface film. This is shown most clearly in FIGS. 2F and 3F. This particular lifting force is most effective when the size of the cavitation bubbles is similar to or slightly smaller in dimension than the cavities or pits in which the bubbles are formed, as well as being similar to or slightly larger than the overall thickness of the film. The thickness of the film which can in fact be removed by cavitation action depends upon the strength as well as hardness of the film and its bond to the substrate.

There are a variety of suitable cavitation-producing systems. Typically, such a system is arranged so that the cavitation producing energy wave is focused on the moving substrate so that basically all of the energy is in the vicinity of the workpiece. This makes relatively high production speeds possible in an efficient manner. One type of system includes ultrasonic devices which produce ultrasonic waves having a frequency greater than 16 kHz. Such systems include piezoelectric, magnetostrictive or electrostatic devices. Very high frequencies, i.e. above 200 kHz, using focused devices, permit high production speeds. In addition a plurality of successive, in-line transducers can be used. Such high frequency devices are shown in U.S. Pat. No. 5,409,594. The '594 patent is directed toward ultrasonic cleaning of substrates by itself, which has proved to be of limited effectiveness.

Cavitation can be produced also at sonic frequencies, in the range of 2 Hz–16 KHz, as well as ultrasonic frequencies above 16 KHz by various resonant mechanical structures, including pipes, horns or nozzles, which can be driven by a variety of power sources. A particularly effective system at such frequencies, for continuous cleaning of substrates, involves the use of a cavitating jet nozzle, where a fluid is pumped through the nozzle at very high pressures. The size and number of the cavitating bubbles with such a system can be controlled by the shape and size of the orifice, as well as the fluid velocity and the particular design of the nozzle.

Figure 4C:
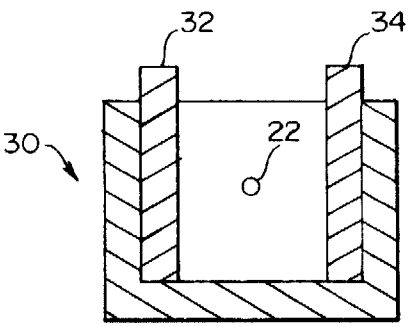
Figure 4B:
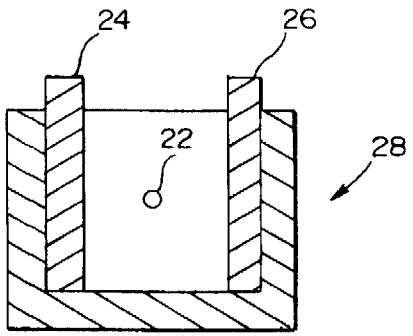
Figure 5A:
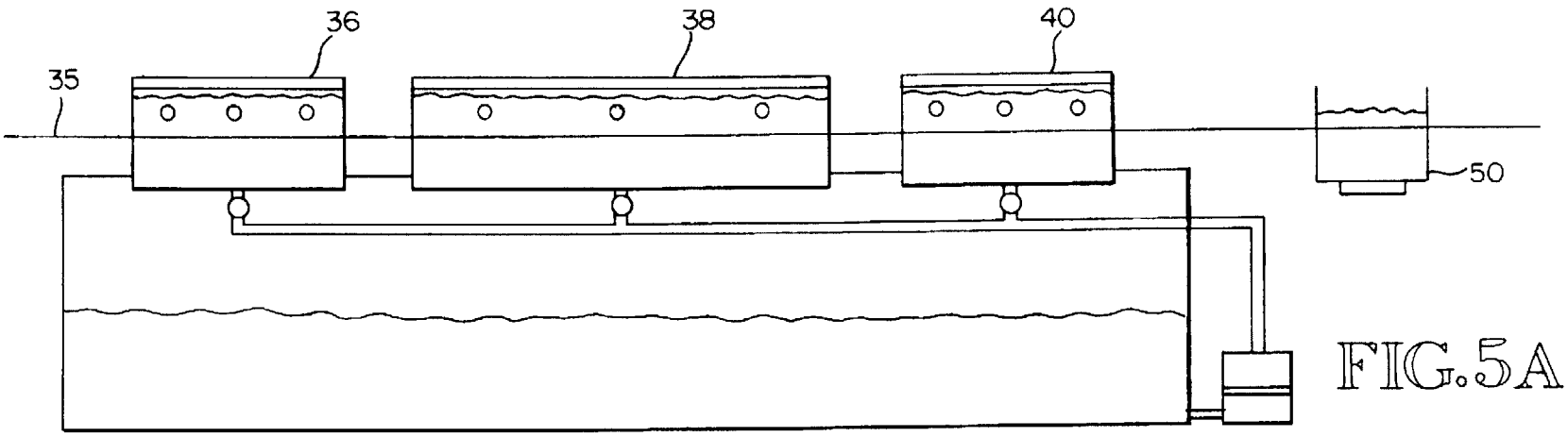
FIGS. 5A–5D is a block diagram showing another embodiment of the system of the present invention.
Figure 5D:
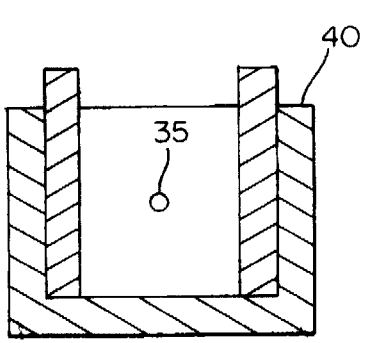
Figure 5C:
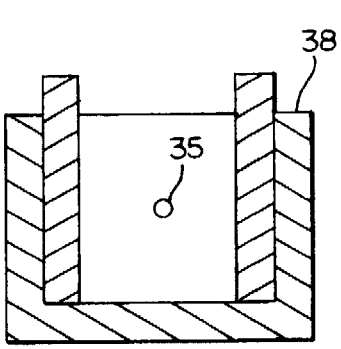
Figure 5B:
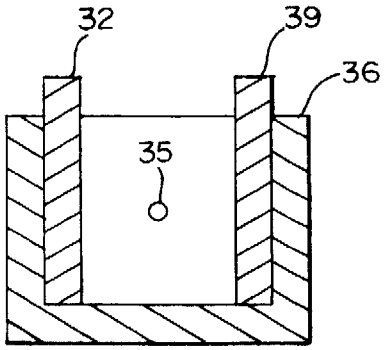

The applicants herein have utilized the above principles, specifically the three sequential steps described above, to effectively clean oxides and lubricants off of various substrates. In one example, a 14 AWG low carbon steel wire was cleaned of both oxide and lubricant. Mechanical stress was first placed on the oxide film to rupture it. The wire was then moved to the electrolysis bath which contained a 40 gram per liter sodium sulfate in a water solution with a counter electrode arrangement, such as shown in FIGS. 4A–4C, where the moving wire was first made cathodic by induction from spaced, essentially insoluble electrodes such as graphite (or iridium oxide on titanium) in the first electrolysis cell, using pulsed DC current at a 50% duty cycle.

The wire was made anodic in a second electrolysis cell using spaced stainless steel cathodes with a pulsed DC signal at a 50 percent duty cycle. The wire was then moved to an ultrasonic cleaning system containing 1.6 MHz PZT transducers in the form of 0.8 inch diameter discs attached to the base of the cleaning tank, focused toward the wire. The processed wire was free of oxides and lubricants, as determined by scanning electron microscopy and X-ray analysis. Previous attempts to remove the oxides and the lubricant by either electrolysis alone or by ultrasound alone were unsuccessful, even after the oxide had been ruptured.

In another example, additional electrolysis cells were used in which the wire alternately became cathodic and anodic. In a third example, the current applied to the electrolysis cell was a constant DC current.

In still other examples, a 0.7 MHz PZT transducer was used to produce the cavitation effect, and in another a 20 KHz transducer was used. In another example, a single electrolysis cell was used, with the polarities of the wire and the spaced electrodes being switched in an alternating fashion. In each case, successful removal of an oxide and/or lubricant was achieved.

In a still further example, a high pressure cavitating water system using a special jet nozzle to stimulate cavitation was used on the film. This system also worked successfully. Hence, ultrasonic transducers are not necessary to produce the desired cavitation.

As indicated above, when an essentially nonporous oxide alone or a combination of such an oxide and a lubricant are to be removed, all three of the above steps must be used, and in the particular order disclosed. However, if only a lubricant or porous oxide is to be removed, the mechanical/thermal stressing step is typically unnecessary. The combination of the electrolysis and cavitation steps in such a case is particularly suited to non-chloride ion containing electrolytes, such as sulphate-containing electrolytes, which prevent formation of undesirable chlorine gas and achieve satisfactory removal of sulfate electrolyte residue due to cavitational rinsing.

As a possible additional step, the wire may be given a final cleaning, shown at 60 in FIG. 1, either by brushing, use of abrasive particles and/or water flushing to clean off any remaining film or residue.

In continuous bipolar cleaning of metal members, it has been discovered that two possible reactions occur on the anodic portion of the metal member. These reactions are:

$$M \rightarrow M^{n+} + ne^- \quad (1)$$

$$2H_2O \rightarrow O_2 + 4H^+ + 4e^- \quad (2)$$

Where: M=metal atom n=valence of the metal ion The reaction that occurs on the cathodic portion of the wire is as follows:

$$2H_2O + 2e^- \rightarrow H_2 + 2OH^- \quad (3)$$

For many metals, such as iron, steel and copper, the overvoltage (which is the voltage required to drive an electrochemical reaction) for reaction (1) is lower than the overvoltage for reaction (2). When the anodic portion of the wire operates below a certain threshold current density, the overvoltage on the metal member can be below the required electrochemical voltage for reaction (2) to occur. In this instance, only reaction (1) will occur on the anodic portion of the metal member. The electrochemical reaction in such a case is operating at a 100% current efficiency for dissolving metal. Certain metals that undergo certain surface treatments (for example, fluidized bed annealed steel wires) will have a low overvoltage for dissolving metal. Bipolar pickling of these metals in a neutral electrolyte generally dissolves too much metal such that the solubility limit for the metal is exceeded at the metal surface. Metal oxides or metal salts will then precipitate on the metal surface, often leaving an electrochemically generated "smut" on the surface.

It has been determined that by lowering the current efficiency for the metal dissolution reaction, by reaction (2) in combination with reaction (1), the following beneficial effects on metal cleaning can be achieved. First, the production of protons ($H^{30}$) from reaction (2) in combination with metal dissolution reaction (1) lowers the pH at the metal surface, thus increasing the solubility limit for the metal ions at the surface of the metal, thus preventing the formation of electrochemically generated smut. Second, the turbulence caused by the production of oxygen gas ($O_2$) from reaction (2) in combination with the metal dissolution reaction (1) increases the rate of diffusion of metal ions away from the surface, which also prevents the formation of electrochemically generated smut.

Furthermore, dissolved metal ions that remain on the surface of the metal member as it enters the cathodic cell can precipitate as an oxide or salt because of the increase in pH at the surface of the metal member due to the hydroxyl ions ($OH^-$) generated by reaction (3). The greater the cathodic current density on the wire, the greater the volume of hydroxyl ions produced per unit area, thus the higher the pH on the surface of the metal member. Therefore, it would be advantageous to operate at a lower cathodic current density (while keeping a high anodic current density). This can be accomplished by increasing the size of the cathodic cell. The following examples illustrate the above principles for a 3 mm. diameter fluidized bed annealed wire.

No. 1: Number of Anodic Wire Cells=4.5

Average Length of Anodic Wire Cell=18 in.

Number of Cathodic Wire Cells=4

Average Length of Cathodic Wire Cell=18 in.

Electrolyte=120 g/L Sodium Sulfate

Electrolyte Temperature=37 ° C.

Operating Current=608 Amps

Operating Voltage=25.0 Volts

Wire Speed=150 ft/min.

Anodic Current Density=2.85 A/cm$^2$

Cathodic Current Density=3.2 A/cm$^2$

Power Input per Ton of Wire=75.0 kwh/ton

No. 2: Number of Anodic Wire Cells=6

Average Length of Anodic Wire Cell=9 in.

Number of Cathodic Wire Cells=5

Average Length of Cathodic Wire Cell=18 in.

Electrolyte=120 g/L Sodium Sulfate

Electrolyte Temperature=63 ° C.

Operating Current=441 Amps

Operating Voltage=24.3 Volts

Wire Speed=150 ft/min.

Anodic Current Density=3.10 A/cm$^2$

Cathodic Current Density=1.86 A/cm$^2$

Power Input per Ton of Wire=52.9 kwh/ton

The above method and system in various examples has proven to be significantly and surprisingly more effective than any of the particular steps taken alone or in any other combination. The system and method are advantageous since there is no requirement for acids or other caustics, and hence, there is no corresponding disposal problem. The system and method is capable, furthermore, of high production rates, so that it is economically competitive.

Although a preferred embodiment of the invention has been disclosed herein for illustration, it should be understood that various changes, modifications and substitutions may be incorporated in such embodiment without departing from the spirit of the invention, which is defined by the claims which follow.

What is claimed is:

1. A system for removing films from metal surfaces, comprising:

means for applying stress to a film on a surface of a metal substrate, so as to rupture the film; means for moving the substrate through an electrolysis cell having two electrode means and an electrolyte, wherein the substrate comprises one of said two electrode means;

means for applying a bipolar electrical signal to the said electrode means in the electrolysis cell such that the electrical signal flows to the substrate, without any direct contact with the moving substrate, resulting in a conditioning effect on at least one of (1) the film and (2) a surface of the metal substrate;

means for immersing said metal substrate in a cavitation fluid and moving said substrate therethrough; and means for generating energy in the cavitation fluid, toward the metal substrate, so that cavitation bubbles are created in locations relative to the film such that when said bubbles expand and collapse in cavitation action, effects are produced which tend to remove the film from the metal substrate.

2. A system of claim 1, wherein the stress applied to the film is mechanical.

3. A system of claim 1, wherein the stress applied to the film is thermal.

4. A system of claim 1, wherein the other electrode means is a single electrode.

5. A system of claim 1, wherein the other electrode means includes two electrode elements, spaced apart from each other, with the substrate moving between the two electrode elements.

6. A system of claim 1, wherein the conditioning effect includes creation of cavities in the surface of the substrate and wherein the dimensions of said cavities are determined by selected characteristics of the electrical signal and the electrolysis cell.

7. A system of claim 6, wherein said selected characteristics of the electrical signal include duty cycle and wherein said selected characteristics of the electrolysis cell include concentration and temperature of the electrolyte.

8. A system of claim 6, wherein the cavitation bubbles are approximately the same size as said cavities in the surface of the substrate.

9. A system of claim 1, wherein the energy-generating means is an ultrasonic frequency transducer.

10. A system of claim 1, wherein the energy-generating means is a sonic frequency transducer.

11. A system of claim 1, wherein the energy-generating means is a cavitating water jet nozzle.

12. A system of claim 1, wherein the electrolysis cell has an electrolyte pH which is selected from the group consisting of (1) neutral, (2) slightly acidic and (3) slightly basic.

13. A system of claim 1, including means for cleaning any remaining residue of the film from the substrate.

14. A system of claim 1, wherein the other electrode means is iridium oxide on titanium.

15. A method for removing films from metal surfaces, comprising the steps of:

applying stress to a film on the surface of a metal substrate so as to rupture the film;

moving the substrate through an electrolysis cell having two electrode means and an electrolyte, wherein the substrate comprises one of said two electrode means;

applying a bipolar electrical signal to said electrode means in the electrolysis cell, such that the electrical signal flows to the substrate, without any direct contact with the moving substrate, resulting in a conditioning effect on at least one of (1) the film and (2) a surface of the metal substrate;

immersing said metal substrate in a cavitation fluid and moving said substrate therethrough; and generating energy in the cavitation fluid, toward the metal substrate, so that cavitation bubbles are created in locations relative to the film such that when said bubbles expand and collapse in cavitation action, effects are produced which tend to remove the film from the metal substrate.

16. A method of claim 15, wherein the other electrode means is a single electrode.

17. A method of claim 15, wherein the other electrode means includes two electrode elements, spaced apart from each other, with the substrate being between the two electrode elements.

18. A method of claim 15, including the step of increasing the overvoltage in selected electrolysis cells where the substrate is anodic to the extent that current efficiency for dissolving metal in said selected electrolysis cells is less than 100%.

19. A method of claim 18, including the step of reducing the size of the other electrode means in said selected electrolysis cells sufficiently that said current efficiency in said selected electrolysis cells is less than 100%.

20. A method of claim 18, including the step of reducing the temperature of the electrolyte in said selected electrolysis cells sufficiently that said current efficiency in said selected electrolysis cells is less than 100%.

21. A method of claim 18, wherein the size of selected electrolysis cells in which the substrate is cathodic is sufficiently large that the pH on the surface of the substrate is not high enough to precipitate any remaining metal ions on the substrate produced in a previous electrolysis cell.

22. A method of claim 15, wherein the conditioning effect includes creation of cavities in the surface of the substrate and wherein the dimensions of said cavities are determined by selected characteristics of the electrical signal and the electrolysis cell.

23. A method of claim 22, wherein said selected characteristics of the electrical signal include duty cycle and wherein said selected characteristics of the electrolysis cell include concentration and temperature of the electrolyte.

24. A method of claim 15, wherein the cavitation bubbles are approximately the same size as the cavities in the surface of the electrodes.

25. A method of claim 15, wherein the energy-generating means is a cavitating jet nozzle.

26. A system for removing a lubricant film from metal surfaces, comprising:

means for moving a metal substrate having a lubricant film thereon through an electrolysis cell having two electrode means and an electrolyte, wherein the substrate comprises one of said two electrode means;

means for applying a bipolar electrical signal to said electrode means in the electrolysis cell such that the electrical signal flows to the substrate, without any direct contact with the moving substrate, resulting in a conditioning effect on at least one of (1) the film and (2) a surface of the metal substrate;

means for immersing said metal substrate in a cavitation fluid and moving said substrate therethrough, wherein the cavitation fluid includes chemical means for assisting in dissolving said lubricant; and means for generating energy in the cavitation fluid, toward the metal substrate, so that cavitation bubbles are created in locations relative to the film such that when said bubbles expand and collapse in cavitation action, effects are produced which tend to remove the film from the metal substrate.

27. A system of claim 26, wherein the conditioning effect includes creation of cavities in the surface of the substrate and wherein the dimensions of said cavities are determined by selected characteristics of the electrical signal and the electrolysis cell.

28. A method for removing a lubricant film from metal surfaces, comprising the steps of:

moving a metal substrate having a lubricant film thereon through an electrolysis cell having two electrode means and an electrolyte, wherein the substrate comprises one of said two electrode means;

applying a bipolar electrical signal to said electrode means in the electrolysis cell, such that the electrical signal flows to the substrate without any direct contact with the moving substrate, resulting in a conditioning effect on at least one of (1) the film and (2) a surface of the metal substrate;

immersing said metal substrate in a cavitation fluid and moving said substrate therethrough, wherein the cavitation fluid includes chemicals for assisting in dissolving said lubricant; and generating energy in the cavitation fluid, toward the metal substrate, so that cavitation bubbles are created in locations relative to the film such that when said bubbles expand and collapse in cavitation action, effects are produced which tend to remove the film from the metal substrate.

29. A method of claim 28, wherein the conditioning effect includes creation of cavities in the surface of the substrate and wherein the dimensions of said cavities are determined by selected characteristics of the electrical signal and the electrolysis cell.

* * * * *